United States Patent [19]

Giffard

[11] 4,152,257

[45] May 1, 1979

[54] CONICAL CONCENTRATOR WITH PARTIAL FLOW COMBINATION

[75] Inventor: Philip J. Giffard, Southport, Australia

[73] Assignee: Mineral Deposits Limited, Australia

[21] Appl. No.: 853,750

[22] Filed: Nov. 21, 1977

[30] Foreign Application Priority Data

Nov. 22, 1976 [AU] Australia ..... PC8216

[51] Int. Cl.[2] ..... B03B 5/00

[52] U.S. Cl. ..... 209/459; 209/498

[58] Field of Search ..... 209/211, 459, 458, 157, 209/155, 498, 497, 460, 8, 477, 484, 488, 506, 316, 332, 172.5, 274, 281, 127, 166; 210/537, 521, 522, 74

[56] References Cited

U.S. PATENT DOCUMENTS

| | | | |
|---|---|---|---|
| 3,379,310 | 4/1968 | Reichert | 209/459 |
| 4,059,506 | 11/1977 | Bryson | 209/211 |

*Primary Examiner*—Robert Halper
*Assistant Examiner*—Jon E. Hokanson
*Attorney, Agent, or Firm*—Stevens, Davis, Miller & Mosher

[57] ABSTRACT

A wet gravity concentration apparatus with means to divide two streams into four streams of different concentration and means to combine the two streams of intermediate concentration. Two conical concentrators are arranged with a first richer stream flowing over one conical surface and a second poorer stream, flowing over the other conical surface. Each surface has a splitter to separate the stream into a concentrated substream rich in value particles and a less concentrated substream composed primarily of tailings. The richer substream of the second poorer stream is combined with the less concentrated substream of the first richer stream so there are three resulting streams. A deflector can be used to combine the two intermediate substreams.

12 Claims, 3 Drawing Figures

CONICAL CONCENTRATOR WITH PARTIAL FLOW COMBINATION

The present invention relates to the gravitational concentration of granular or particulate ores; the ore being treated in the form of a pulp (that is, a suspension of solid particles in water) wherein the required or value particles have a specific gravity higher than that or those of the remaining or unwanted particles.

In particular, the invention relates to conical concentrators whereby a pulp stream flowing downwardly towards the apex region of a cone is brought into contact with a splitter and caused to separate into a concentrate stream rich in value particles and a less concentrated stream composed primarily of the unwanted particles or tailings.

It is generally found that the production of acceptable concentrates or tailings requires more than a single separation stage and the successful operation of a cascaded series of gravitational separators may require that the concentrates generated by one concentration stage should be combined with the tailings produced by another concentrator at approximately the same stage in the cascaded series.

It is an object of the present invention to provide an apparatus for producing such a combined stream of particles in a very simple manner, permitting the two pulp streams to be treated in a relatively compact and simple apparatus.

According to the invention there is provided apparatus for the wet gravity concentration of particulate ores comprising upper and lower substantially concentric downwardly convergent cones having their axes substantially vertical, upper and lower splitters located at the apex region of the upper and lower cones respectively, each splitter being adapted to divide a wet stream of particulate ore flowing downwardly over the upper surface of the respective cone into a concentrated stream which flows through one or more apertures and a less-concentrated stream which flows over the splitter away from said one or more apertures characterised in that the arrangement causes the concentrated stream from said upper cone to combine with the less-concentrated stream from the lower cone.

Preferably, the splitters are substantially in vertical register and a deflector is located beneath the one or more apertures of the upper splitter to direct the concentrated stream from the upper cone into the less-concentrated stream from the lower cone.

A preferred embodiment of the invention will now be described, by way of example only, with reference to the accompanying drawings in which.

Figure 1:
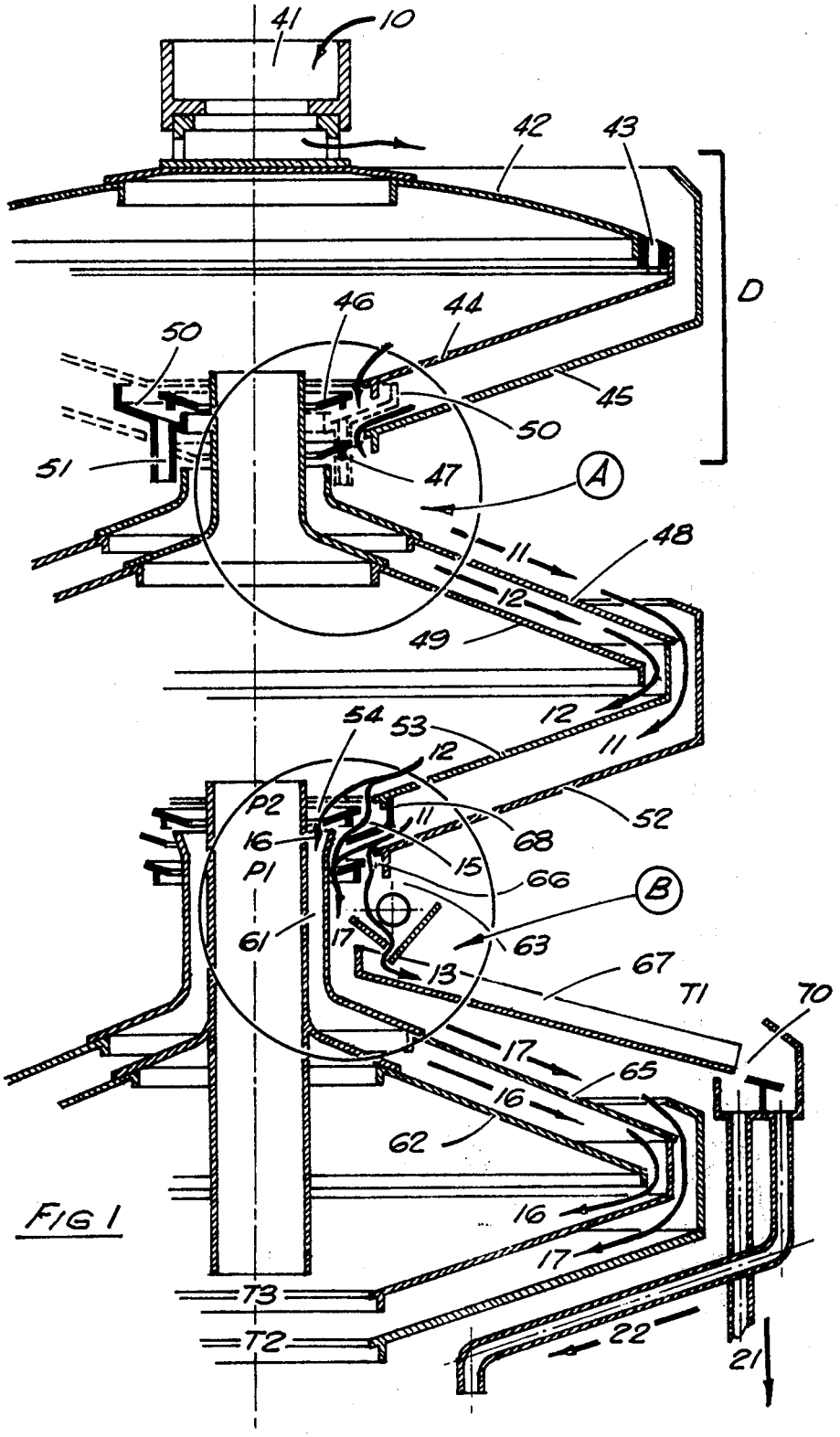
FIG. 1 is a sectional side elevation of the upper part of a cascaded series of cone concentrators.

Referring to the drawings, feed grade material 10 is admitted to the cascaded series of cone concentrators at point 41 and flows downwardly over the upper surface of a fanning cone 42. At the periphery 43 of the fanning cone 42, approximately equal proportions of the pulp is admitted onto the upper surfaces of two concentrator cones 44 and 45 respectively.

Figure 2:
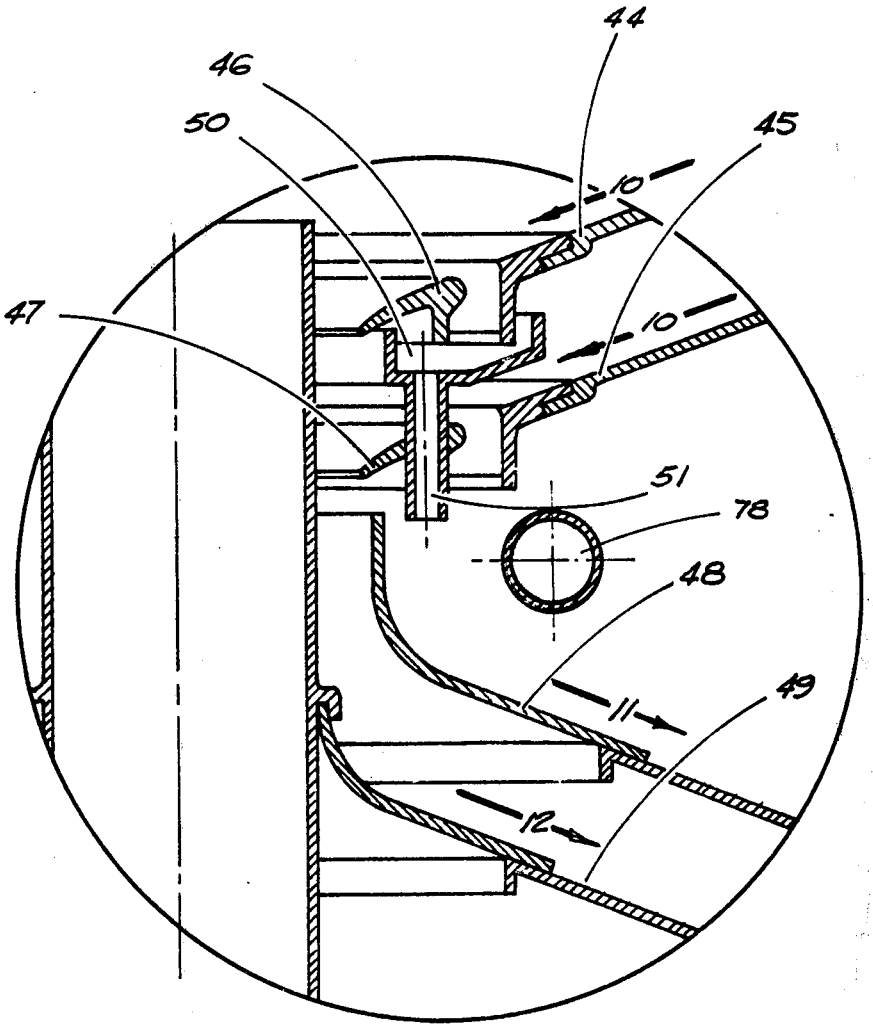
FIG. 2 is an enlarged view of that portion of the apparatus indicated by circle "A" in FIG. 1.

As the two streams approach the apex region of their respective cones, they come into contact with splitter rings 46 and 47 respectively which divide the flow into a tailings stream 12 which passes onto the upper surface of a subsequent distribution cone 49 and a concentrate stream 11 which flows onto the upper surface of a corresponding distribution cone 48. It will be observed that the concentrates produced by the cone 44 pass into an annular trough 50 from which they flow through a plurality of circumferentially spaced downwardly extending tubes 51 past the tailings flow from cone 45 and onto the outer surface of cone 48 along with the concentrates produced by cone 45, as best shown in FIG. 2.

From the distribution cones 48 and 49 the fanned streams are admitted to the upper surfaces of two concentric and downwardly converging cones 52 and 53 respectively and it will be apparent that the stream admitted to cone 52 will be of a higher quality than the corresponding stream flowing onto cone 53. In the particular configuration illustrated in FIG. 1, the tailings produced from the relatively rich stream on cone 52 will be of approximately the same value as the concentrates produced from the relatively poor stream flowing down cone 52 when these streams have been subjected to a further concentrating process performed at the apex portion of their respective cones. In subsequent refining stages it is therefore possible to treat both the cone 53 concentrates and the cone 52 tailings in a single concentrator with resultant savings in machine complexity and cost. The present embodiment provides a very simple means by which the cone 53 concentrates are prevented from contaminating the richer cone 52 concentrates and added to the stream of tailings produced by cone 52.

Figure 3:
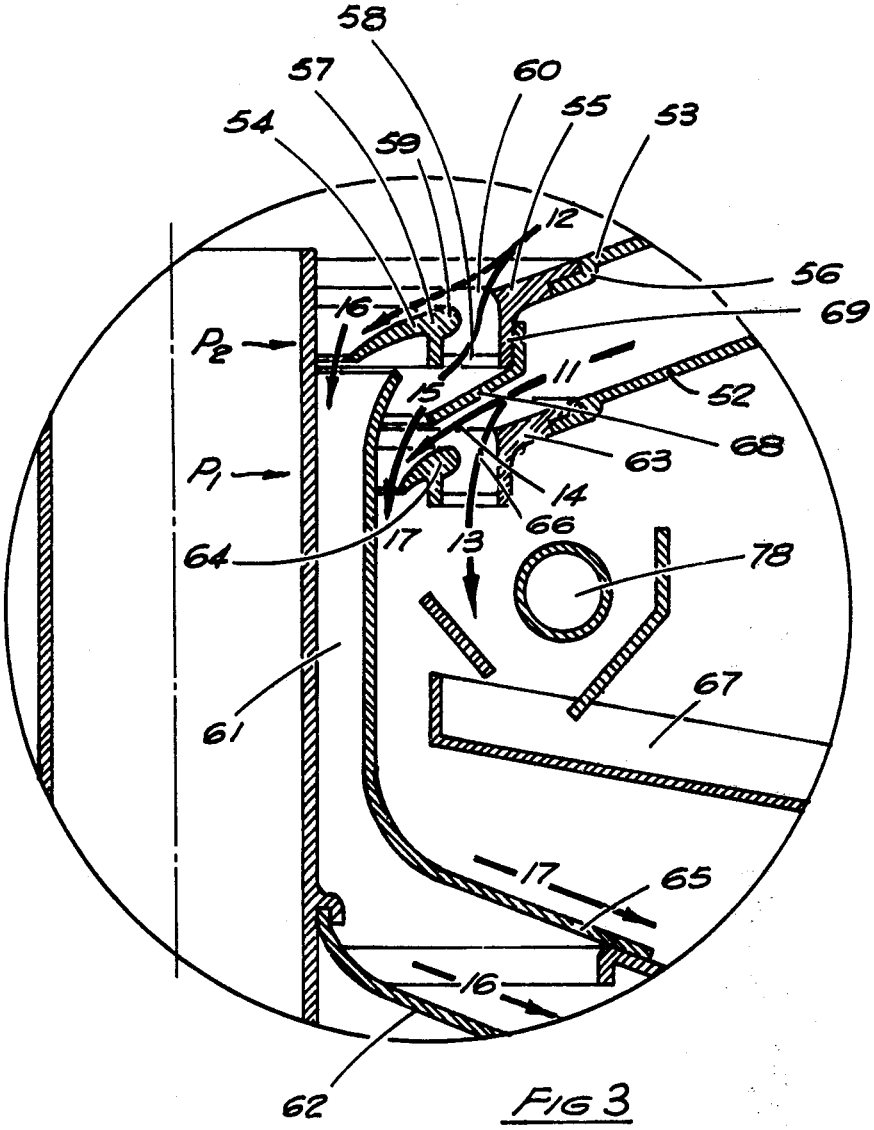
FIG. 3 is an enlarged view of that portion of the apparatus indicated by circle "B" in FIG. 1, illustrating in greater detail a preferred embodiment of the invention.

Referring now to the enlarged illustration provided by FIG. 3, the upper cone 53 is provided at its apex region with an upper splitter 54. The splitter 54 comprises an annular support flange 55 which engages with the lower edge 56 of the cone 53 so as to maintain a substantially continuous upper surface along which the ore stream 12 may flow, as well as serving to support a contoured inner splitter ring 57.

The ring 57 is adjustably attached to the flange 55 by several radial support arms 58. These arms can be secured to the flange 55 in any one of a number of circumferentially spaced positions of differing height such that the elevation of the ring 57 can be varied by rotating it relative to the flange 55. In this way, the contoured leading edge 59 of the ring 57 can be made to confront the flow passing over the flange 55 at any one of a number of different angles.

A wet stream of particulate ore 12 flowing over the cone 53 and flange 55 will strike the leading edge 59 of the splitter 54 and divide into two streams of differing concentration depending upon the particular relative positions of the ring 57 and flange 55. The more concentrated stream 15 flows downwardly through an annular aperture 60 between the ring 57 and flange 55, the flow path being substantially unaffected by the support means 58. The second, or less concentrated tailings stream 16 flows over the ring 57 and into an annular passage 61 from which it flows onto the upper surface of a subsequent distribution cone 62.

The stream 11 decending cone 52 encounters a similar splitter 63 such that its tailings stream 14 is directed over a ring 64 and onto the underlying cone 65 while its more concentrated stream 13 flows through aperture 66 and onto one or more separation trays 67 for a further stage of concentration.

In order to effect the required combination of the streams 14 and 15, the upper splitter 54 is provided with a downwardly extending annular deflector 68 which is frusto-conical in form and attached to a generally cylindrical flange 69 depending from the splitter support flange 55. The deflector 68 extends beneath the aperture 60 to direct the concentrated stream 15 issuing therefrom into the tailings stream 14 produced to the lower splitter 63, at the same time preventing the concentrated stream 15 from contaminating the more highly concentrated stream 13 falling onto the tray 67 from the lower splitter 63.

The subsequent distribution cones 62 and 65 are similar to cones 49 and 48 described above and communicate respectively with subsequent separation cones. These subsequent separation cones incorporate a similar splitter arrangement to that previously described and illustrated in FIG. 3 and in this way, the cascaded series of separators can be extended to any required length, with concentrates and tailings being drawn off at appropriate stations. In this way, the present invention permits the construction of relatively simple and compact concentrator combinations.

It will be appreciated that the present invention is not limited to the use of a deflector as described. The deflector may, for example, be constructed as a series of shutes, pipes or other conduits which catch the concentrates flowing from the splitter aperture and deflect or shed them into the tailings stream produced by the lower cone. Alternatively, the deflector may be omitted if the radial dimensions of the two splitters are chosen so as to cause the concentrated stream from the upper cone to fall directly into the less-concentrated stream from the lower cone.

The claims defining the invention are as follows:

1. Apparatus for the wet gravity concentration of particulate ores comprising upper and lower substantially concentric downwardly convergent cones having their axes substantially vertical with their apex regions positioned downwardly, splitter means having at least one aparture located at the apex region of the upper and lower cones to divide a wet stream of particulate ore flowing downwardly over the upper surface of each cone into a concentrate stream flowing through said at least one aperture and a less-concentrated stream flowing over said at least one aperture, and stream combining means to combine the concentrate stream flowing through said at least one aperture in said upper cone with the less concentrated stream from said lower cone.

2. Apparatus as defined in claim 1 wherein said stream combining means comprises said at least one aperture in said upper cone which is positioned radially inward of said at least one aperture in said lower cone whereby the concentrated stream flowing from the upper cone flows only into the less cncentrated stream of said lower cone.

3. A cascaded series of cone concentrators including apparatus as defined in claim 1.

4. Apparatus as defined in claim 1 wherein said stream combining means comprises a deflector located beneath said at least one aperture of said splitter means for said upper cone to direct the concentrated stream from said upper cone into the less-concentrated stream from said lower cone.

5. A cascaded series of cone concentrators including apparatus as defined in claim 4.

6. Apparatus as defined in claim 4 wherein said deflector is substantially continuous.

7. Apparatus as defined in claim 4 wherein said splitter means are substantially in vertical register.

8. Apparatus as defined in claim 7 wherein said deflector is frusto-conical.

9. Apparatus as defined in claim 7 wherein at least said upper splitter means includes an annular ring having a contoured leading edge directed towards the downwardly flowing wet stream, said at least one aperture of said upper splitter means being defined by an annular space between said leading edge and the adjacent cone.

10. Apparatus as defined in claim 9 wherein said deflector is frusto-conical.

11. Apparatus as defined in claim 9 wherein said upper and lower splitter means are substantially identical and said deflector is arranged in roof relationship to the lower annular space to shed the concentrated stream from said upper cone into the less-concentrated stream from said lower cone.

12. A cascaded series of cone concentrators including apparatus as defined in claim 11.

* * * * *